United States Patent [19]

Shorter, Jr.

[11] Patent Number: 4,559,891

[45] Date of Patent: Dec. 24, 1985

[54] PONTOON

[76] Inventor: Myron L. Shorter, Jr., 834 Vellejo Ave., Novato, Calif. 94547

[21] Appl. No.: 629,064

[22] Filed: Jul. 9, 1984

Related U.S. Application Data

[63] Continuation of Ser. No. 401,864, Jul. 26, 1982, abandoned.

[51] Int. Cl.[4] ..... B63B 35/38

[52] U.S. Cl. ..... 114/263; 405/218; 114/267

[58] Field of Search ..... 114/266, 267, 263, 74 R, 114/357, 65 A; 52/405, 576, 577, 309.12, 323; 403/267, 336, 335; 220/216, 218, 226, 901; 264/274, 275, 277, 279; 405/218, 219

[56] References Cited

U.S. PATENT DOCUMENTS

| | | | |
|---|---|---|---|
| 1,307,224 | 6/1919 | Weber | 114/65 A |
| 1,507,721 | 9/1924 | Waite | 52/577 |
| 2,198,688 | 4/1940 | Williamson | 264/274 |
| 2,879,735 | 3/1959 | Pointer | 114/266 |
| 3,037,652 | 6/1962 | Wallace | 264/279 |
| 3,179,076 | 4/1965 | Sheffield | 114/267 |
| 3,193,855 | 7/1965 | Chapman | 114/267 |
| 3,387,075 | 6/1968 | Wilcox | 264/279 |
| 3,448,709 | 6/1969 | Hardwick, Jr. | 114/266 |
| 3,580,202 | 5/1971 | Thompson | 114/266 |
| 3,811,141 | 5/1974 | Stoeberl | 114/357 |
| 3,930,347 | 1/1976 | Megumi | 52/405 |
| 3,967,569 | 7/1976 | Shorter, Jr. | 114/266 |

*Primary Examiner*—Trygve M. Blix
*Assistant Examiner*—Edwin L. Swinehart
*Attorney, Agent, or Firm*—Bielen & Peterson

[57] ABSTRACT

A pontoon utilizing a container having a bottom portion and side portions which extend upwardly from the bottom. The top of the container is covered by a cap which may be moldable material, such as concrete. The cap is held to the container forming a pontoon.

6 Claims, 5 Drawing Figures

PONTOON

This is a continuation of application Ser. No. 401,864 filed July 26, 1982 now abandoned.

BACKGROUND OF THE INVENTION

The present invention relates to a novel pontoon which is especially useful in the construction of marinas.

Pontoons have been constructed of many materials such as metal and concrete. U.S. Pat. No. 3,091,203 describes a concrete floating wharf structure which utilizes concrete pontoons. U.S. Pat. No. Re. 24,837 again utilizes concrete pontoons with tie rails or whalers extending between the floats to hold them together. Bolts are embedded in the concrete to hold the tie rails. U.S. Pat. No. 3,128,737 used a through rod construction in place of the insert bolts.

More recently, pontoons for marinas have been constructed of plastic-like material. For example, reference is made to U.S. Pat. Nos. 4,041,716 and 4,051,591, which employ high density polyethylene material for the pontoon shell.

Although the plastic-like pontoon shell is resistant to salt water deterioration and easy to manufacture, this pontoon lacks the durability of the concrete pontoon; especially in the upper portions which are used as the deck and the means for connecting adjacent pontoons.

A pontoon which exhibits the advantages of the concrete and plastic-like floats would be an advance in marina construction.

SUMMARY OF THE INVENTION

In accordance with the present invention, a novel and useful pontoon is provided which is useful in the construction of marinas.

The pontoon of the present invention utilizes an open container which has a bottom portion and side portions extending upwardly therefrom. The container may be constructed of plastic, wood, or any other material. If formed from plastic, the container would possess a degree of resiliency which is quite useful in shallow water situations.

The pontoon also includes a moldable cap which covers the top of the container. The moldable cap may be constructed of concrete-like material. Means is also provided for holding the moldable cap to the container for use in conjunction with the container. The means for holding the moldable cap to the open container may include a flange extending from the container side portions. Means for connecting the flange to the moldable cap is also included and may take the form of molding the flange to the cap. Also, the moldable cap may include a member extending from the periphery thereof. A rod may extend from the top to the bottom of the member and hold at least one stringer along the pontoon. The rod and stringer may also compress the container flange to the member of the moldable cap. In one aspect of the invention, the rod may pass through the container flange when the flange is held in compression.

The present invention may also embrace the pontoon wherein the moldable cap includes a shaft having a first portion inside the moldable cap and a second portion extending to the exterior of the same. The stringer would extend along one side of the pontoon and include means for holding the stringer to the second portion of the shaft. The second portion of the shaft may also be constructed to extend through the moldable cap to another side of the pontoon such that the shaft includes a third portion which extends to the exterior of the moldable cap along the another side of the pontoon. Another stringer may also be included, which extends along the another side of the pontoon and include means for holding the another stringer to the third portion of the shaft. Thus, stringers would be located and held along two sides of the pontoon.

It may be apparent that a novel and useful pontoon has been described.

It is therefore an object of the present invention to provide a pontoon which is simple to manufacture from a container which may be prefabricated, having a moldable cap which may be easily attached to the prefabricated container.

It is another object of the present invention to provide a pontoon which is durable and may protect a foam filling therewithin.

It is another object of the present invention to provide a pontoon which is highly resistant to salt water corrosion and cracking in shallow water conditions.

It is yet another object of the present invention to provide a pontoon which may utilize existing connection systems commonly employed to assemble concrete floats.

It is still another object of the present invention to provide a pontoon which has a top deck portion constructed of pavement material.

A further object of the present invention is to provide a pontoon which has a shallower draft than concrete floats possessing the same buoyant force.

The invention possess other objects and advantages, especially as concerns particular characteristics and features thereof which will become apparent as the specification continues.

For a better understanding of the invention, reference is made to the following detailed description.

DESCRIPTION OF PREFERRED EMBODIMENTS

Various aspects of the various invention will evolve from the following detailed description of the preferred embodiments thereof, which should be taken in conjunction with the heretofore described drawings.

Figure 1:
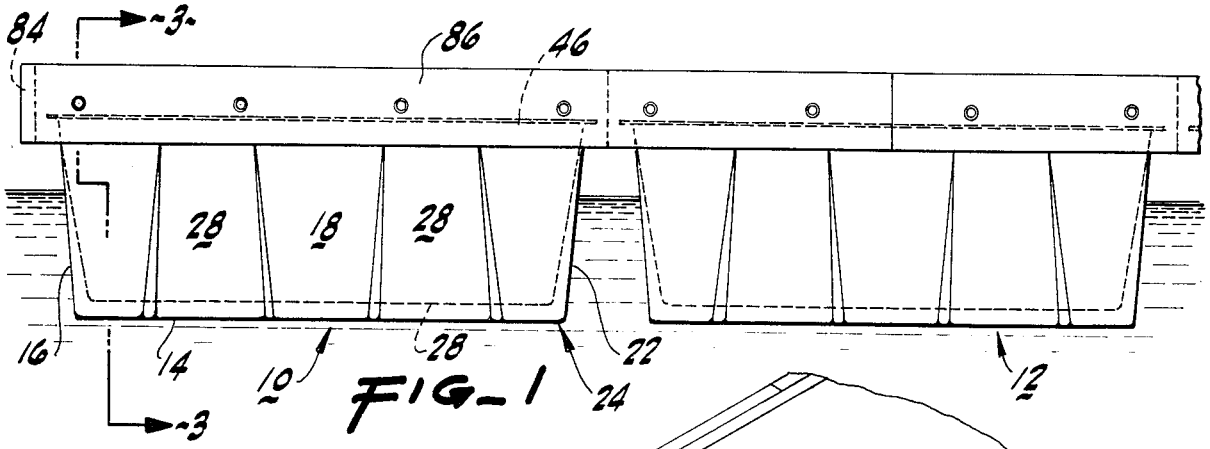
FIG. 1 is a side elevational view of a pair of pontoons of the present invention connected into a unit.
Figure 2:
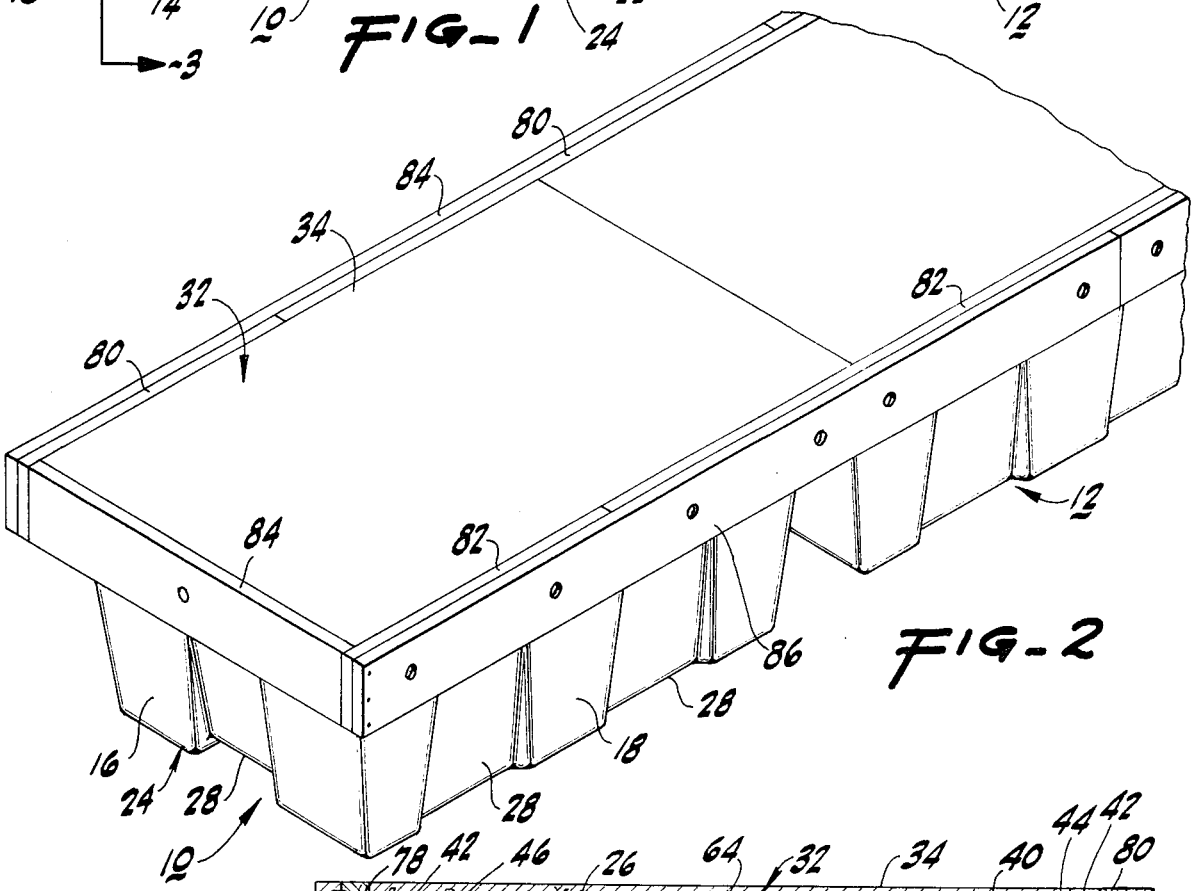
FIG. 2 is a broken top perspective view of a pair of pontoons connected as a unit.
Figure 3:
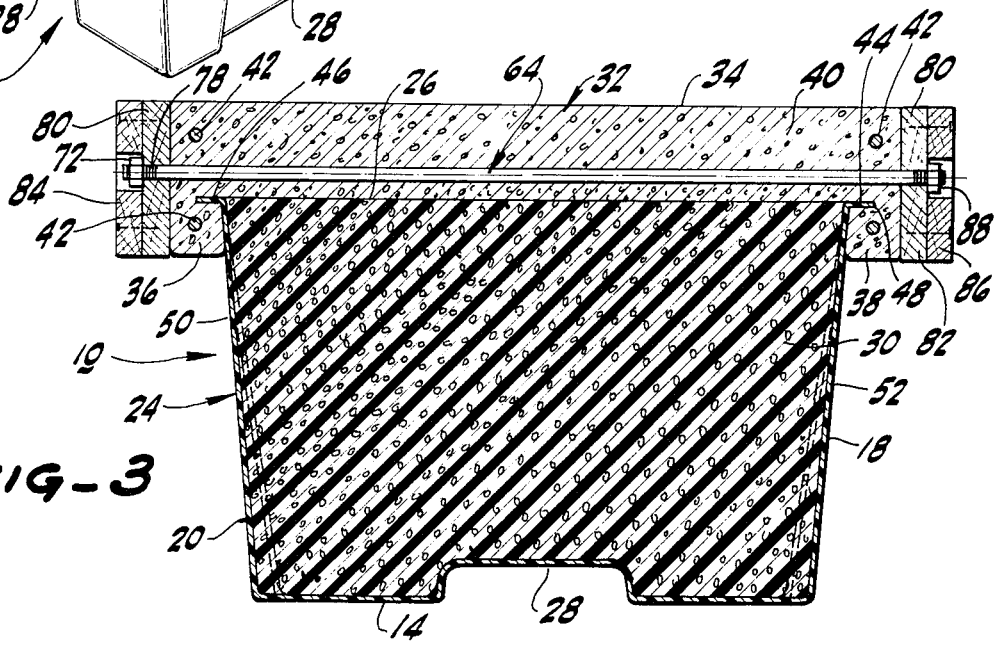
FIG. 3 is a sectional view taken along line 3—3 of FIG. 1.

With reference to the drawings, FIGS. 1 and 2 show a pair of pontoons 10 and 12 of the present invention interconnected. It should be noted that pontoon 10 and pontoon 12 are substantially identical in construction. Pontoon 10 includes a bottom 14 and side portions 16, 18, 20, and 22 which extend upwardly from bottom 14 to form a container 24 having a top portion 26. Container 24 may be molded out of plastic material and include a plurality of indentations 28 which are inherent to that process. Container 24 may be filled with foam-like material 30, FIG. 3. Foam material 30 may be injected into container 24 in liquid form and harden at a later time within container 24.

Pontoon may also include a moldable cap 32 which covers top portion 26. Cap 32 may be formed of any moldable material, such as concrete-like paving compounds, asphalt, sulfur compounds and the like. Basic concrete has been found to be satisfactory in this regard. Cap 10 includes an upper deck 34 and side members 36 and 38 which are formed continuously with plate member 40 in the embodiment shown in the drawings. With a plurality of reinforcement bars 42 add to the structural strength of cap 32.

Figure 4:
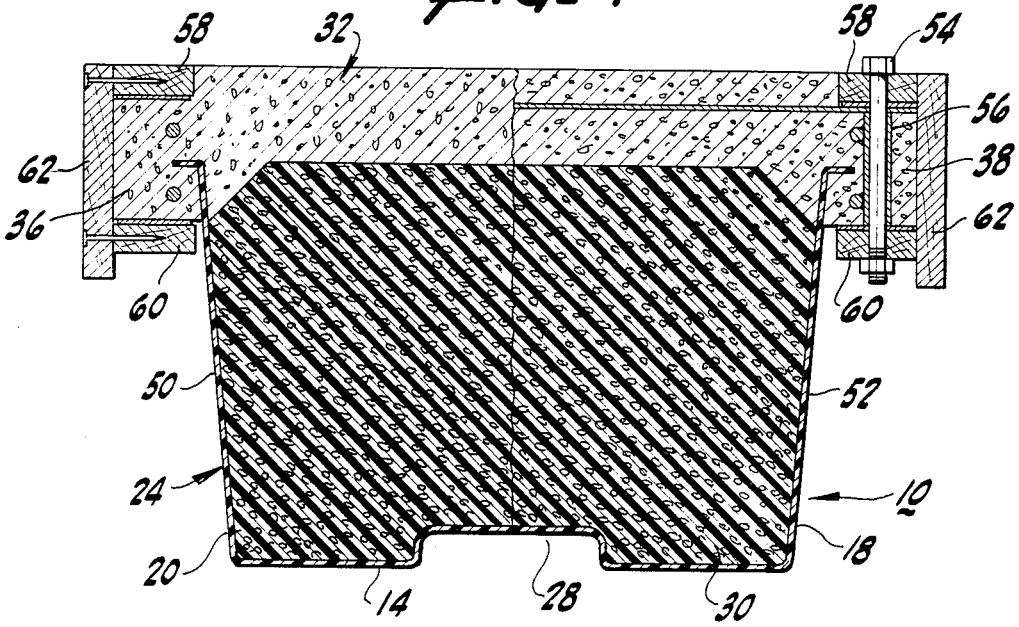
FIG. 4 is a sectional view of a pontoon of the present invention utilizing a interconnection system different from that shown in FIGS. 1–3.
Figure 5:
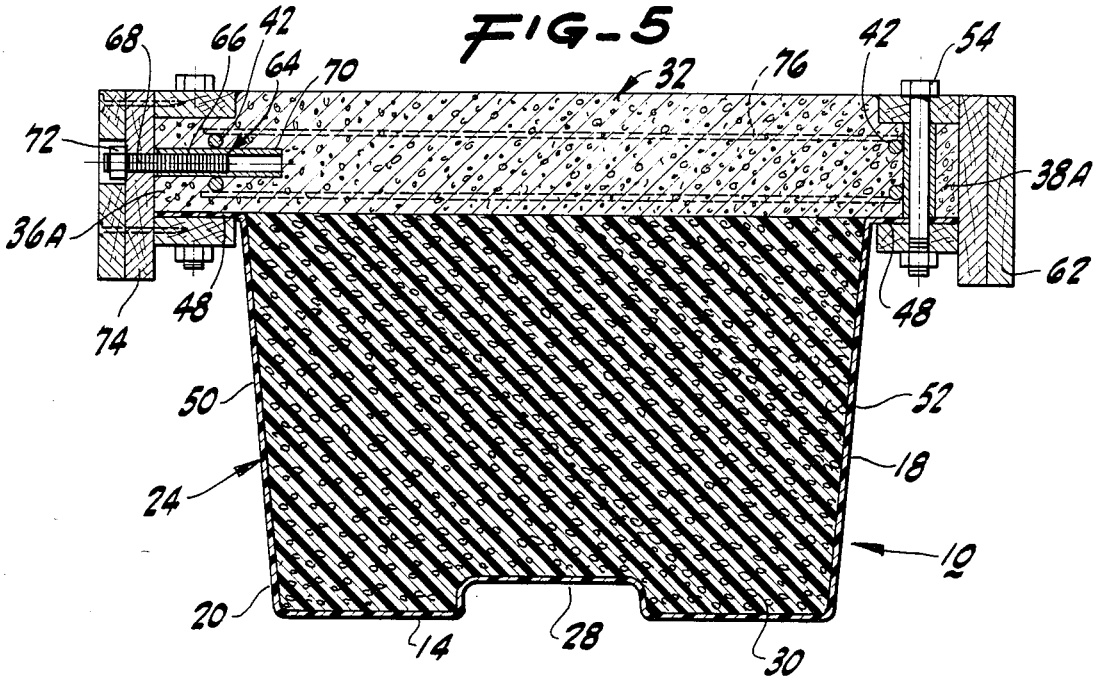
FIG. 5 is a sectional view of the pontoon of the present invention utilizing a different connection system from that shown in FIGS. 1–4.

The invention also embraces means 44 for holding moldable cap 32 to container 24. Means 44 may take the form of providing container 24 with flanges 46 and 48 which extend along the sides 50 and 52 of pontoon 10. Flanges 46 and 48 are molded into members 36 and 38 during the formation process for pontoon 10. With reference to FIG. 4, it may be seen that member 38 may include a threaded rod or bolt 54 within a sleeve 56 which extends from top to bottom of member 38. A pair of stringers, or whalers, 58 and 60 interconnect float 10 with an adjacent float such as float 12 using the interconnection system found in U.S. Pat. No. 4,043,287. A fender board 62 is nailed to stringers 58 and 60. With reference to FIG. 5, it may be seen that bolt 54 may pass through flange 48 of container 24. In such a case, side members 38A and 40A would extend outwardly from cap plate 40 without molding flange 48 therewithin.

With reference to FIG. 5, it may be seen that a shaft 64 may be provided having a first portion 66 inside the moldable cap 32 and a second portion 68 which extends to the exterior of molded cap 32. First portion 66 of shaft 64 fits within a sleeve 70 embedded within moldable cap 32. Shaft 64 may have a threaded section which engages a nut 72 which holds a stringer 74 along side 50 of container 24. Thus, in FIG. 5 it may be seen that the interconnection system shown on the left side of pontoon 10, such as that shown in U.S. Pat. No. Re. 24,837, and the interconnection system shown on the right side of pontoon 10, heretofore identified, are useable with the pontoon 10 of the present invention. Again, straps 76 may be used in conjunction with plurality of reinforcement bars 42 to strengthen cap 32.

Returning to FIG. 3, it may be seen that shaft 64 may extend completely through cap 32 and form a third portion 78 which extends to the exterior of molded cap 32 on side 52 of pontoon 10. Stringers 80 and 82 and fender boards 84 and 86 may be used in conjunction with the through rod interconnection system shown in FIG. 3. A second nut 88 may be employed to hold stringer 82, side member 38 on side 52 of pontoon 10.

In operation, container 24 is fastened or otherwise connected to moldable cap 32 to form pontoon 10. Pontoon 10 may be filled with foam-like material 30 if desired. Pontoon 10 may be connected to a identical pontoon 12 by the use of any known interconnection means employed in the case of concrete floats. Pontoon 10 enjoys the advantage of concrete floats in that the upper portion is durable and capable of being interconnected while the bottom portion may be resilient and resistant to salt water corrosion and mechanical forces imposed by wave action.

While in the foregoing specification, embodiments of the present invention have been set forth in considerable details for the purposes of making a complete disclosure of the invention, it will be apparent to those of skill in the art that numerous changes may be made in such details without departing from the spirit and principles of the invention.

What is claimed:

1. A pontoon for use in floating docks comprising:

a. a preformed container comprising a bottom portion, and side portions extending upwardly therefrom forming a top portion;

b. a moldable cap covering said top portion of said container; said moldable cap having an upper surface useable as a platform; and c. means for holding said moldable cap to said preformed container, including a flange extending from a part of said side portions of said container, said flange being moldably embedded within said moldable cap, said preformed container and moldable cap held thereto being floatable in water with said moldable cap above said preformed container.

2. The pontoon of claim 1 in which said moldable cap is formed of a concrete-like material.

3. The pontoon of claim 1 in which said moldable cap includes a member extending from the periphery of said moldable cap, said member including a rod extending from the top to the bottom of said member, said rod holding at least one stringer along the pontoon.

4. The pontoon of claim 1 in which said moldable cap includes a shaft having a first portion, inside said moldable cap, and a second portion extending to the exterior of said moldable cap, one stringer along one side of said pontoon and means for holding said one stringer to said second portion of said shaft.

5. The pontoon of claim 4 in which said first portion of said shaft extends through said moldable cap to another side of said pontoon and said shaft further includes a third portion extending to the exterior of said moldable cap along said another side of said pontoon.

6. The pontoon of claim 4 in which said pontoon further includes another stringer extending along said another side of said pontoon, and means for holding said another stringer to said third portion of said shaft.

* * * * *